United States Patent [19]

Batchelor

[11] 4,153,243

[45] May 8, 1979

[54] REMOTE CONTROL DEVICE FOR MODEL AIRPLANE

[76] Inventor: Dewitt L. Batchelor, P.O. Box 303, Guthrie, Ky. 42234

[21] Appl. No.: 854,712

[22] Filed: Nov. 25, 1977

[51] Int. Cl.[2] ..... A63H 27/04

[52] U.S. Cl. ..... 272/31 A

[58] Field of Search ..... 272/31 A, 31 B, 31 R; 46/77; 35/12 B, 12 L, 12 W, 12 P; 74/471 R, 501 R

[56] References Cited

U.S. PATENT DOCUMENTS

| | | | |
|---|---|---|---|
| 2,390,307 | 12/1945 | Kelecius | 272/31 A |
| 2,543,965 | 3/1951 | Hamilton | 74/471 X |
| 2,650,827 | 9/1953 | Hamilton | 272/31 A |

FOREIGN PATENT DOCUMENTS

| | | | |
|---|---|---|---|
| 1341447 | 9/1963 | France | 272/31 A |

*Primary Examiner*—Richard C. Pinkham
*Assistant Examiner*—Arnold W. Kramer
*Attorney, Agent, or Firm*—Harrington A. Lackey

[57] ABSTRACT

A remote control device for a model airplane including a mast, a rotary bracket, a yoke member projecting upward from and rotatable with the bracket, and a guide arm having its proximal end journaled in said yoke member for swinging movement through a complete arc of at least 180°. Control lines connected to a model airplane are guided along the guide arm and terminate in a vertical carrier reciprocably mounted on a track on the rotary bracket. The carrier is moved by a remotely controlled actuator to alternate the linear movements of the control lines. The model airplane may thus be controlled to perform almost unlimited maneuvers, including overhead maneuvers and "wing-overs" in addition to the normal circling movement around the mast at different altitudes.

8 Claims, 8 Drawing Figures

REMOTE CONTROL DEVICE FOR MODEL AIRPLANE

BACKGROUND OF THE INVENTION

This invention relates to the controlled flight of model airplanes, and more particularly to a remote control device for a model airplane.

Remote control mechanisms for controlling the flight of motorized model airplanes are well-known in the art. Examples of such remote control mechanism are disclosed in the following U.S. patents:

| | | |
|---|---|---|
| 2,478,351 | Wood | Aug. 9, 1949 |
| 2,692,775 | Marsh | Oct. 26, 1954 |
| 2,907,569 | Taylor | Oct. 6, 1959 |
| 2,913,244 | Cottle, Jr. | Nov. 17, 1959 |
| 2,977,117 | Taylor | Mar. 28, 1961 |
| 3,014,718 | Telzrow | Dec. 26, 1961 |
| 3,446,502 | Damron et al | May 27, 1969 |
| 3,053,533 | Weymouth | Sep. 11, 1962 |

Many of these prior patents provide means for manually and remotely controlling the flight of the model airplane about a central mast by locating the manual control actuator outside the periphery of the flight of the plane.

Most of the above patents disclose control mechanisms including levers, cables and bell cranks, which, when manipulated, cause the control lines attached to the airplane elevator to move linearly alternately in opposite directions in order to cause the plane to fly level, climb or descend.

The Marsh U.S. Pat. No. 2,692,775, discloses a portion of the control mechanism journaled upon the stationary mast for rotation around the mast with the circumferential flight of the model airplane about the mast.

However, none of the reference disclose a mechanism which will permit the plane, its control lines and line-guiding mechanism to pivot and swing completely overhead during the circumferential flight of the plane.

SUMMARY OF THE INVENTION

It is therefore an object of this invention to provide a remote control device for a model airplane which not only includes manual controls for the flight of the plane circumferentially of a mast from a station outside the peripheral flight of the airplane, but also includes novel control elements for alternately and linearly moving the control lines in opposite directions.

It is another object of this invention to provide a remote control device for a model airplane including a control line guide arm pivotally mounted at the top of the mast assembly which is free to swing the plane in a complete overhead arc of at least 180°, and to permit more versatile maneuvering of the plane, such as "wing-overs."

The remote control device made in accordance with this invention includes a central mast having a rotary bracket on top thereof, a track member projecting upward from and movable with the bracket terminating in an upper yoke member. The yoke member pivotally supports the proximal end of the guide arm for complete swinging overhead movement. The control lines for the plane are guided along the guide arm and attached to a carrier vertically movable upon the track member, one of the control lines being reversed over a control guide on the bracket to permit the remote ends of the control lines to alternately move in opposite directions when the carrier is alternately moved in vertical directions on its track member.

The carrier is connected through appropriate control elements, such as a vertically movable control rod, a bell crank and manually controlled cables to a manual actuator device located outside the periphery of the circumferential flight of a plane about the mast.

DESCRIPTION OF THE PREFERRED EMBODIMENT

Figure 1:
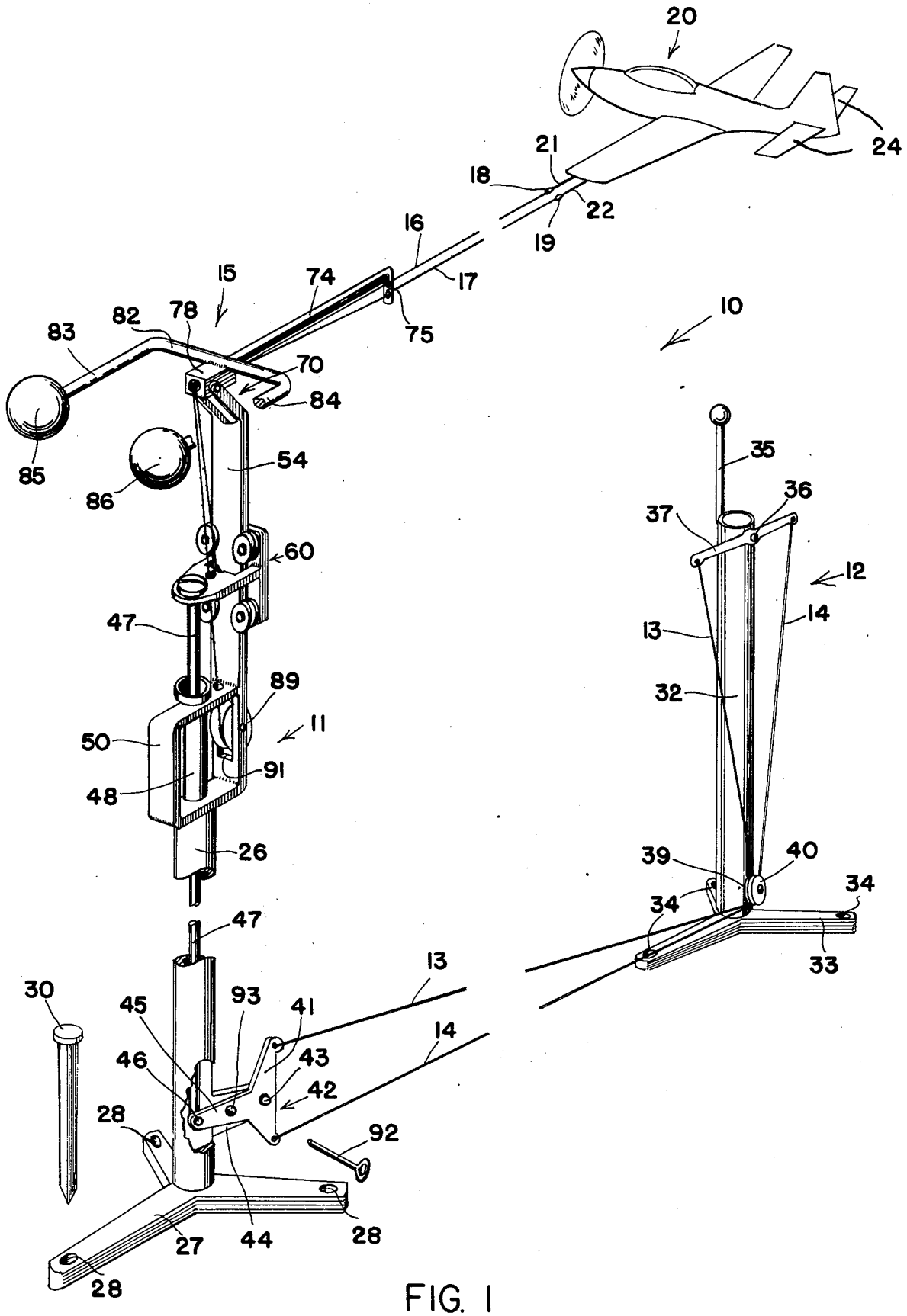
FIG. 1 is a perspective view of the device made in accordance with this invention, with portions broken away for clarity.

Referring now to the drawings in more detail, FIG. 1 discloses the remote control device 10 made in accordance with this invention including a mast assembly 11, a remotely stationed actuator device 12, actuator lines 13 and 14, a control arm assembly 15 and control lines 16 and 17. The control lines 16 and 17 are connected by detachable connectors 18 and 19, respectively, to elevator lines 21 and 22, respectively, which are connected by linkages, not shown, within the model airplane 20 to the elevator 24 in order to raise and lower the elevator 24 in response to movement of the elevator lines 21 and 22. The mechanism for linking and controlling the elevator 24 within the model airplane 20 are not shown, but are well-known in the art.

The mast assembly 11 includes an upright, hollow tubular mast 26 terminating at its lower end in a Y-shaped base member 27 having vertical holes 28 formed in the extremities of the arms of the base member 27 for receiving anchor pins, such as 30. Thus, the mast 26 may be fixed in a vertical stationary position at the desired center of flight trajectory for the model airplane 20 by placing the Y-shaped base member 27 upon the ground and driving or otherwise inserting each of the pins 30 through a corresponding anchor hole 28.

The actuator device 12 includes a vertical column 32 also terminating at its lower extremity in an integral Y-shaped base member 33 having vertical anchor holes 34 at the extremities of each of the arms of the base member 33. Anchor pins, not shown, but similar to the anchor pins 30 are inserted through the anchor holes 34 in order to fix the column 32 in a stationary position upon the ground remote from the mast 26, and preferably outside the circular flight trajectory of the model airplane 20 about the vertical axis of the mast 26.

An actuator handle lever 35 is fixed to one end of a pivot pin 36 journaled diametrically horizontally through the upper portion of the column 32. The other end of the pin 36 is fixed in the middle of an arm 37 the extremities of which are connected to the proximal ends of the actuator lines 13 and 14. The actuator lines 13 and 14 are trained about corresponding pulleys 39 and 40 freely rotatably journaled upon the lower portion of the column 32. The remote ends of the actuator lines 13 and 14 are connected to opposite extremities of the arms 41 of a T-shaped bell crank 42 journaled by pin 43 upon the laterally extending bracket 44 of the mast 26. The extremity of arm 45 of the bell crank 42 is connected by pin 46 to vertically reciprocable control rod 47 mounted coaxially within the hollow mast 26.

Forming a reduced upward extension of the mast 26 and fixed thereto is a coaxial hollow tubular hub member 48 defining an annular bearing surface 49 at the juncture between the bottom of the hub member 48 and the upper end of the mast 26. The vertical control rod 47 is adapted to extend coaxially upward through, not only the mast 26 but the hub member 48.

A rotary bracket 50 in the shape of an upright rectangular frame has vertically aligned holes 51 and 52 therein for journalling the bracket 50 upon the hub member 48 for rotary movement about the vertical axis of the hub member 48.

Projecting straight upward from one side of the bracket 50 is an elongated vertical track member 54 having elongated parallel vertical track surfaces 55 and 56.

A collar 58 may be threadedly secured to the upper portion of the hub member 48 in order to retain the rectangular bracket 50 upon the hub member 48. The bottom surface of the rotary bracket 50 bears upon the bearing surface 49 for relative rotary movement.

Adapted to ride vertically and reciprocably upon the track member 54 is a control line carrier 60 having a vertical plate 61 supporting upper and lower wheels or roller bearings 62 spaced upon opposite sides of the track member 54 and adapted to rollably engage the respective track surfaces 55 and 56. Projecting horizontally from one side of the vertical plate 61 between the upper and lower roller bearings 62 is a horizontal carrier plate 64 including a rectangular recess 65 adjacent the vertical plate 61 for slidably receiving the vertical track member 54. The outer extremity of the horizontal plate 64 is provided with a hole 66 rotatably engaging a bearing 67 screwed into the internally threaded, open flanged end of the control rod 47. Thus, the carrier 60 is adapted to be moved vertically and reciprocably with the control rod 47, and is rotatable with the rotary bracket 50 about the control rod 47. Also formed in the horizontal carrier plate 64 is a control line passage hole 68 and a control line connection recess 69.

Projecting upward at an angle from the top of the track member 54 is a yoke member 70 having a pair of upwardly extending, horizontally spaced apart ears 71 and 72.

The control rod assembly 15 includes an elongated guide arm 74 having its front end depending in a guide flange 75 including a pair of vertically spaced guide holes or apertures 76 and 77. The rear end of the guide arm 74 is fixedly attached to a rear guide block 78 having an elongated guide channel 79 therethrough with flared ends. The rear end of the guide block 78 is journaled between the yoke ears 71 and 72 by a journal pin 80, to swing freely and vertically within the space 73.

Fixed to the top of the guide block 78 and extending transversely thereof is a straddle bar 82 terminating in a pair of counterweight arms 83 and 84 projecting parallel to each other but in the opposite direction from the guide arm 74 and terminating in counterweights 85 and 86, respectively.

The control lines 16 and 17 extend through the respective guide apertures 76 and 77 in the depending flange 75 of the guide arm 74. Both control lines 16 and 17 extend through the guide channel 79 and then depend downwardly to the carrier 60. The control line 16 extends through the guide hole 68 in the horizontal carrier plate 64 and then through a hole 88 in the bracket frame 50. The direction of the control line 16 is then reversed about the guide sheave 89 journaled in the cut-out side portion 91 of the frame 50. The upward extending leg of the control line 16 is then fixed to the carrier 60 by extending the proximal end of the control line 16 through the hole 90 and then tying the end of the control line 16 in a knot to form a loop through the hole 90, as disclosed in FIGS. 5 and 6.

Figure 5:
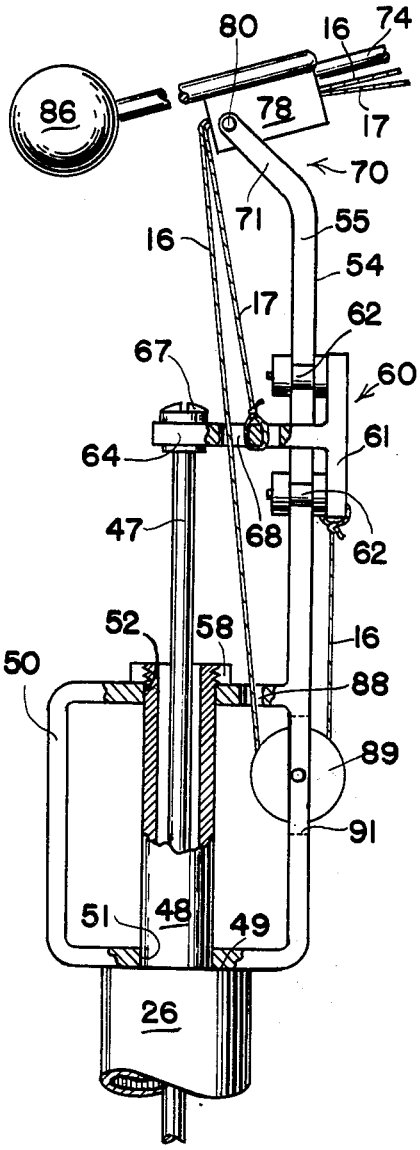
FIG. 5 is an enlarged, fragmentary, elevation of the upper portion of the mast assembly, with portions broken away.

The proximal end of the control line 17 is looped around the bridge formed between the guide hole 68 and the guide recess 69 and tied in a knot, as disclosed in FIG. 5, to fix the proximal end of the control line 17 directly to the horizontal plate 64 of the carrier 60.

Figure 3:
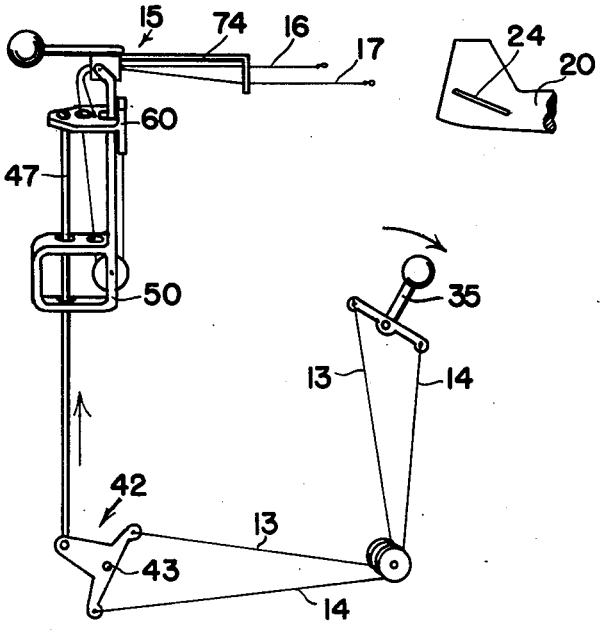
FIG. 3 is a schematic diagram in side elevation disclosing the control elements in their respective operative positions for raising the elevator of the plane to cause it to climb.

Thus, by virtue of the connections of the proximal ends of the control lines 16 and 17 to the carrier 60, it will be evident from FIGS. 3 and 5 that when the control rod 47 and carrier 60 move upward, the control line 17 will be permitted to be withdrawn or extended from the remote end of the guide arm 74, while the remote end of the control line 16 will be retracted toward the guide arm 74, as best disclosed in FIG. 3. When the direction of the vertical control rod 47 and the carrier 60 are reversed to move downward, then the remote end of the control line 16 will be extended, while the remote end of the control line 17 will be retracted relative to the control arm 74, as best disclosed in FIG. 4.

As best disclosed in FIG. 3, the upward movement of the control rod 47 and the carrier 60 is effected by shifting the handle lever 35 in the clockwise direction of FIG. 3 to move the actuator lines 13 and 14 in reverse directions, as disclosed in FIG. 3, thereby rotating the bell crank 42 about the pivot pin 43 in a clockwise direction to force upward the control rod 47.

Figure 4:
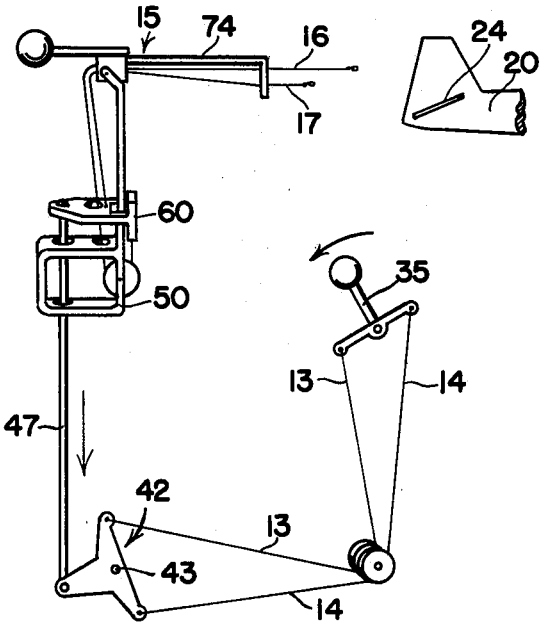
FIG. 4 is a view similar to FIG. 3, but showing the control elements in their reversed operative positions for depressing the elevator to cause the plane to descend.

The downward movement of the control rod 47 and the carrier 60 is effected by moving the lever handle 35 in the opposite, counter-clockwise direction, reversing the movements of the actuator lines 13 and 14 to rotate the bell crank 42 in the reverse, counter-clockwise direction about the pivot pin 43 in order to lower the vertical control rod 47, as disclosed in FIG. 4.

When it is desired to hold the lever handle 35, bell crank 42, vertical control rod 47 and carrier 60 in a neutral position to maintain the model airplane 20 in level flight, a latch pin 92 (FIG. 1) may be provided to insert through a hole 93 in the bell crank arm 45 and into a corresponding aligned hole (not shown) within the bracket arm 44, if desired.

Figure 2:
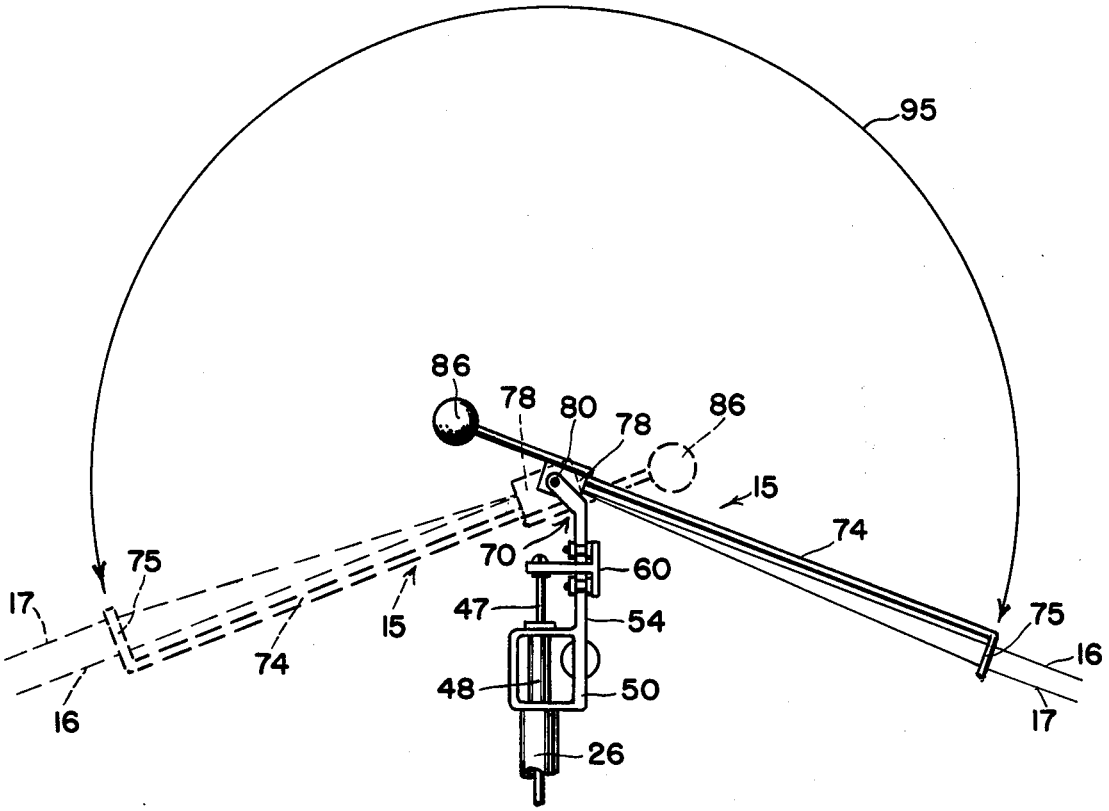
FIG. 2 is a fragmentary side elevation of the top portion of the mast assembly disclosing the guide arm and control lines in one flying position in solid lines and in another flying position at the opposite extremity of an overhead arc in phantom.
Figure 6:
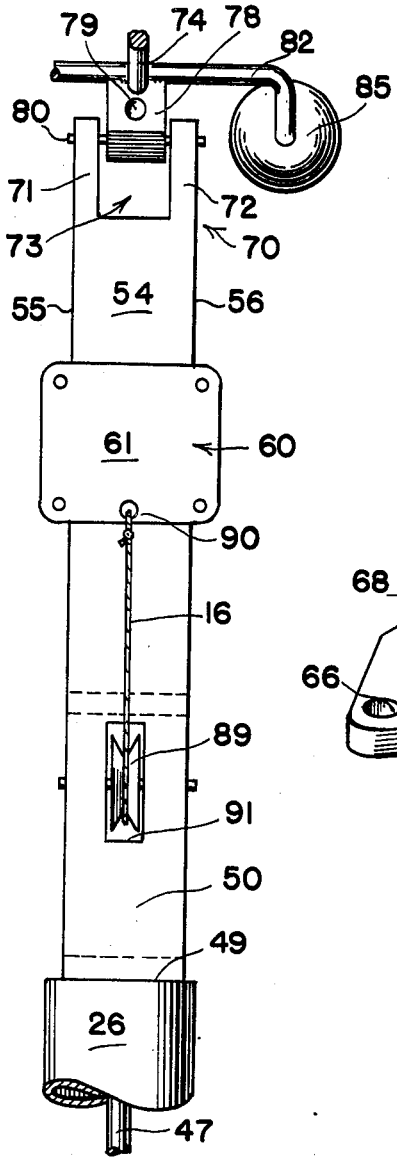
FIG. 6 is a fragmentary, rear elevation of the top portion of the mast assembly disclosed in FIG. 5, with portions broken away.
Figure 7:
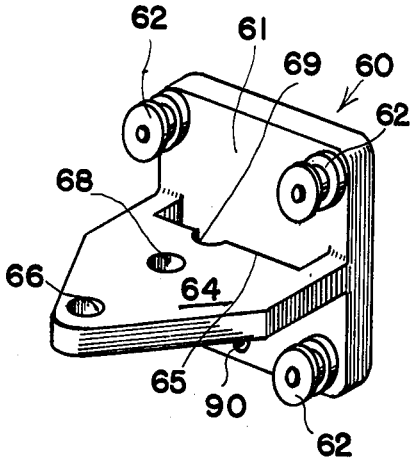
FIG. 7 is a front perspective view of the control line carrier.
Figure 8:
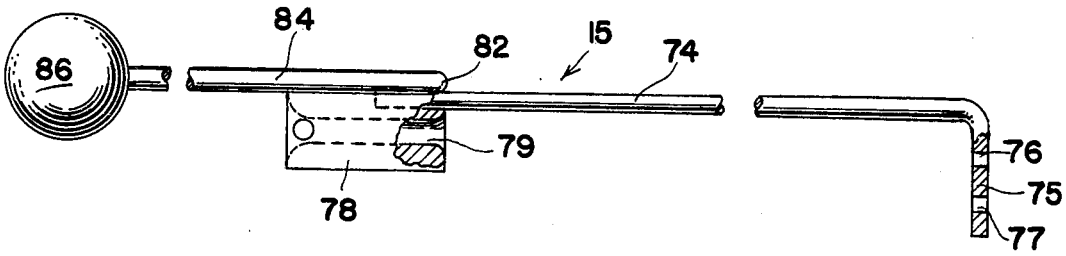
FIG. 8 is a side elevational view of the guide arm, with portions broken away.

As best disclosed in FIGS. 2, 5 and 6, the control arm assembly 15 is permitted to swing through an overhead arc, which is substantially greater than 180°, so that even while the model airplane 20 is traveling in its normal circular flight about the vertical axis of the mast 26, not only can the plane 20 ascend and descend through limited heights, but also it can fly completely over the vertical axis of the mast 26, such as from the solid-line position of the guide arm 74 in FIG. 2 to the dotted-line position of the guide arm 74 in FIG. 2 through overhead arc 95. One such maneuver is referred to as a "WING OVER."

Such overhead maneuvers are permitted by the depth of the pivotal space 73 between the yoke ears 71 and 72 being sufficiently greater than the corresponding vertical dimension of the rear or proximal portion of the guide block 78, so that the guide block 78 can swing freely within the space 73 without being limited by any blocking obstacle.

Furthermore, the straddle bar 82 maintains the counterweight arms 83 and 84, as well as the counterweights 85 and 86, far enough on opposite sides of the ears 71 and 72 that they clear, not only the yoke member 70, but also the track 54 and the carrier 60, as the control arm assembly 15 swings through its overhead arc 95.

It will thus be seen that a remote control device 10 for a model airplane 20 has been developed which provides considerable versatility in permitting additional maneuvers of the model airplane 20 not contemplated by previous remote control devices.

The operator of the control device 10 may station himself outside the circular flight path of the model airplane 20 by fixing the actuator device 12 at a distance from the mast assembly 11 greater than the radius of the circular flight path of the model airplane 20. Then by standing in one position, and manipulating the lever handle 35, the elevator 24 is manipulated through the control lines 16 and 17 to move the plane 20 in various degrees of ascent and descent. Moreover, the degrees of ascent may be great enough to fly the model airplane 20 directly over the vertical axis of the mast 26, as disclosed by the overhead arc 95 in FIG. 2, even while the plane 20 is moving under its motor power in its normal circular path about the vertical axis of the mast 26.

It will be seen that while the vertical control rod 47 and the carrier 60 are being manipulated by the lever handle 35 through the actuator lines 13 and 14 in order to control the alternate linear movement of the control lines 16 and 17 in opposite directions, the bracket 50 is continually rotating upon the bearing surface 49 and about the hub member 48 so that the bracket 50, track member 54, yoke 70, control line 16 and 17 and the control arm assembly 15, always have the same orientation relative to the model airplane 20, by virtue of their simultaneous rotary movement with the bracket 50.

What is claimed is:

1. A remote control device for a model airplane having elevator controls, comprising:

(a) an upright mast having a base for supporting said mast on a stationary surface, (b) a rotary bracket supported upon said mast for rotary movement about a vertical axis, (c) an elongated guide arm having remote and proximal end portions, (d) means for journaling the proximal end portion of said guide arm on said rotary bracket for swinging movement of said guide arm about a horizontal axis, (e) control lines mounted on said guide arm for guided linear movement, said control lines having remote ends connectable to the elevator controls of a model airplane, and proximal end portions extending from the proximal end portion of said guide arm, (f) a control line carrier mounted on said rotary bracket for vertical reciprocal movement, (g) a reversing guide member on said rotary bracket, (h) the proximal end of one of said control lines being directly fixed to said carrier, and the proximal end of another of said control lines being directed around said reversing guide member and fixed to said carrier, whereby the vertical movement of said carrier on said rotary bracket in one vertical direction causes the remote ends of said control lines to move in opposite directions and the movement of said carrier in said opposite vertical direction causes the remote ends of said control lines to move in directions reversed to said opposite directions, (i) actuator means connected to said carrier for moving said carrier in opposite vertical directions.

2. The invention according to claim 1 in which said actuator means further comprises a vertical control rod fixed to said carrier, said control rod being mounted upon said mast for vertical reciprocal movement thereof.

3. The invention according to claim 2 in which said control rod is mounted coaxially of said mast and the vertical rotary axis of said rotary bracket is coaxial of said mast.

4. The invention according to claim 3 in which said rotary bracket comprises a vertical track member projecting upward therefrom, said carrier being mounted on said track member for vertical movement thereof.

5. The invention according to claim 4 in which said carrier comprises roller bearings engaging said track member to permit rolling movement of said carrier along said track member.

6. The invention according to claim 1 further comprising a yoke member projecting upward from said rotary bracket, said means for journaling the proximal end portion of said guide arm pivotally mounting said proximal end portion on said yoke member for swinging movement of said guide arm through an overhead arc of at least 180°.

7. The invention according to claim 6 further comprising counter-balancing means on said proximal end portion of said guide arm.

8. The invention according to claim 6 in which said yoke member comprises a pair of upstanding spaced yoke ears, forming a vertical space therebetween, the proximal end of said guide arm being adapted to swing freely through said vertical space for the full extent of the swinging movement of said guide arm, a pair of counter-balance members fixed to said guide arm and projecting in the opposite direction from said guide arm on opposite sides of said guide arm and outside said yoke ears so that said counter-balance members can swing freely throughout the swinging movement of said guide arm.

* * * * *